US006948407B1

(12) United States Patent
Hsien

(10) Patent No.: US 6,948,407 B1
(45) Date of Patent: Sep. 27, 2005

(54) BOX END WRENCH

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/797,115

(22) Filed: Mar. 11, 2004

(51) Int. Cl.[7] ..... B25B 13/00
(52) U.S. Cl. ..... 81/124.3; 81/185; 81/124.1
(58) Field of Search ..... 81/124.1, 124.3, 81/124.7, 185, 121.1

(56) References Cited

U.S. PATENT DOCUMENTS 2,488,894 A * 11/1949 Barrett ..... 81/124.1
2,811,631 A * 10/1957 Wood, Jr. ..... 81/121.1
3,349,655 A * 10/1967 Locke ..... 81/185
3,674,070 A * 7/1972 Mahoney ..... 81/185
3,779,105 A * 12/1973 Triplett et al. ..... 81/185
3,858,468 A * 1/1975 Pasbrig ..... 81/185
5,168,781 A * 12/1992 Tenuta ..... 81/121.1
5,249,489 A * 10/1993 Weisman ..... 81/124.1
6,860,176 B1 * 3/2005 Hsien ..... 81/124.1

* cited by examiner

*Primary Examiner*—James G. Smith

(57) ABSTRACT

A box end wrench includes an annular flange extending from a first side thereof and an inner diameter is larger than a maximum inner diameter of the box end. A compressible member is engaged with a second side of the box end and can be compressed by an object engaged with the box end. The compressible member pushes the object from the toothed inner periphery of the box end to a space enclosed by the annular flange, so that the object is retained in the box end while the handle of the wrench is allowed to be rotated in counter clockwise.

5 Claims, 7 Drawing Sheets

BOX END WRENCH

FIELD OF THE INVENTION

The present invention relates to an improved box end of a wrench and may retain the object to be rotated in the box end without removing the box end from the object.

BACKGROUND OF THE INVENTION

A conventional wrench with a box end is used for a long time and the box end includes a toothed inner periphery so as to engage a polygonal object such as a nut. The object is enclosed by the box end and cannot be slid from the box end during rotation of the wrench. Nevertheless, if there is an obstacle located beside the object, the handle of the wrench cannot be rotated freely, the user has to remove the box end from the nut completely and then re-engage the nut after the handle is arranged to a proper position. This increases the time required to tighten or loosen the nut and is not an efficient tool. To improve the problem, a ratchet box end tool is developed and allows the user to reciprocally operate the box end wrench without removing the box end from the nut. However, the ratchet wrench involves too many parts and the assembling processes are complicated.

The present invention intends to provide a box end wrench without ratchet mechanism and can be used as a ratchet wrench.

SUMMARY OF THE INVENTION

The present invention relates to a wrench comprising a box end connected to an end of a handle. The box end has a toothed inner periphery for engaging a polygonal object. An annular flange extends from a first side of a periphery of the box end and an inner diameter of the annular flange is larger than a maximum inner diameter of the toothed inner periphery of the box end. A compressible member is engaged with a second side of the periphery of the box end and a part of the compressible member is located in a space enclosed by the toothed inner periphery.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
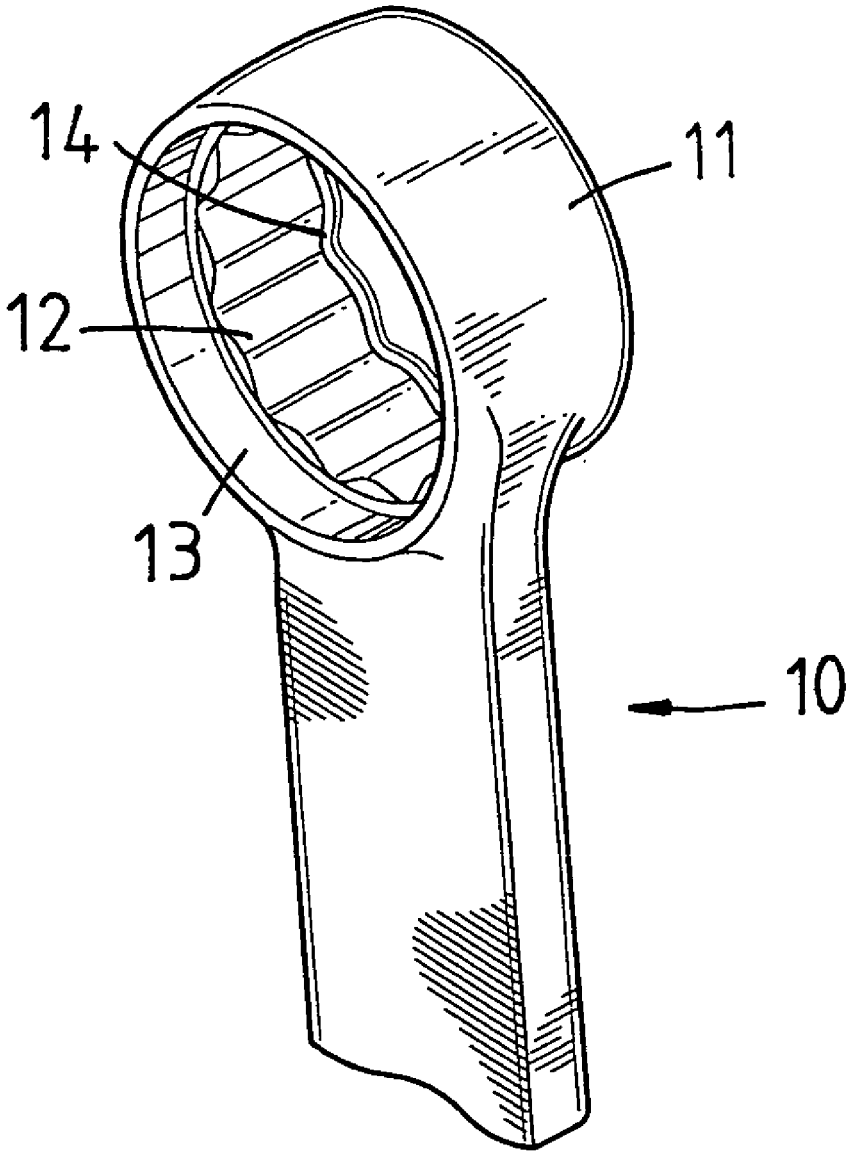
FIG. 1 is a perspective view to show the wrench with a box end of the present invention.
Figure 2:
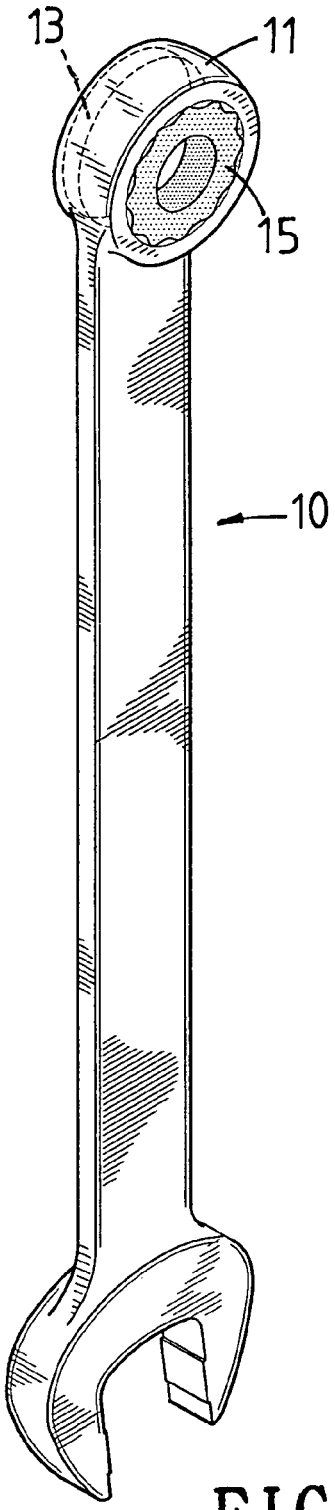
FIG. 2 shows the wrench having a box end which shows the flexible member on one side thereof and an open end.
Figure 3:
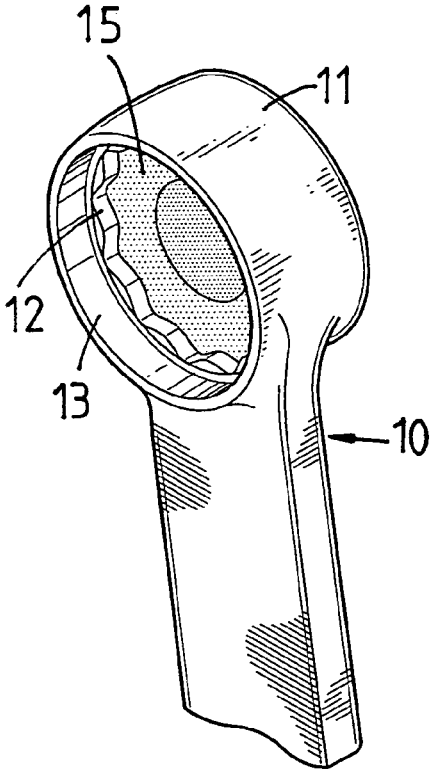
FIG. 3 shows the flexible member is inserted in the box end.
Figure 4:
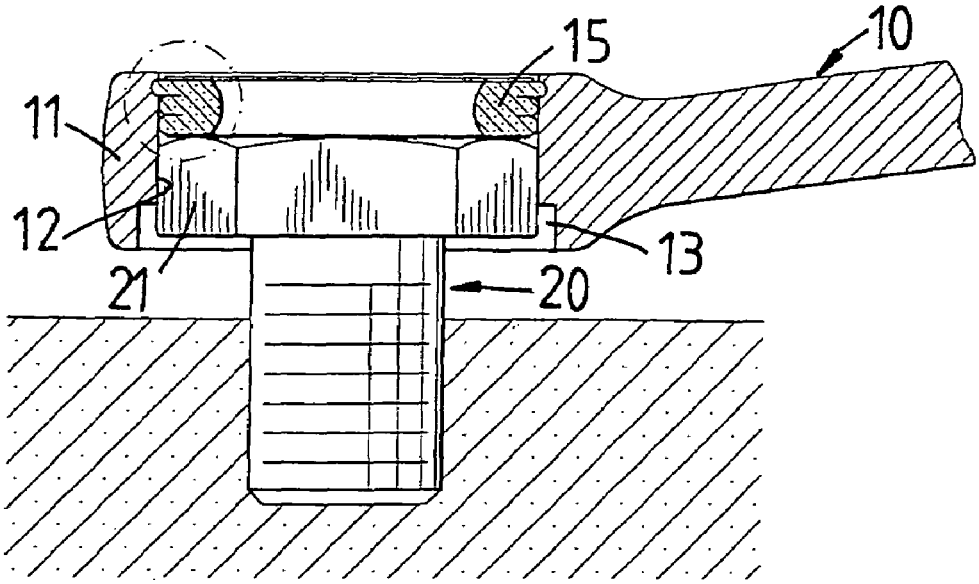
FIG. 4 shows the flexible member is compressed by the object during operating the wrench.
Figure 6:
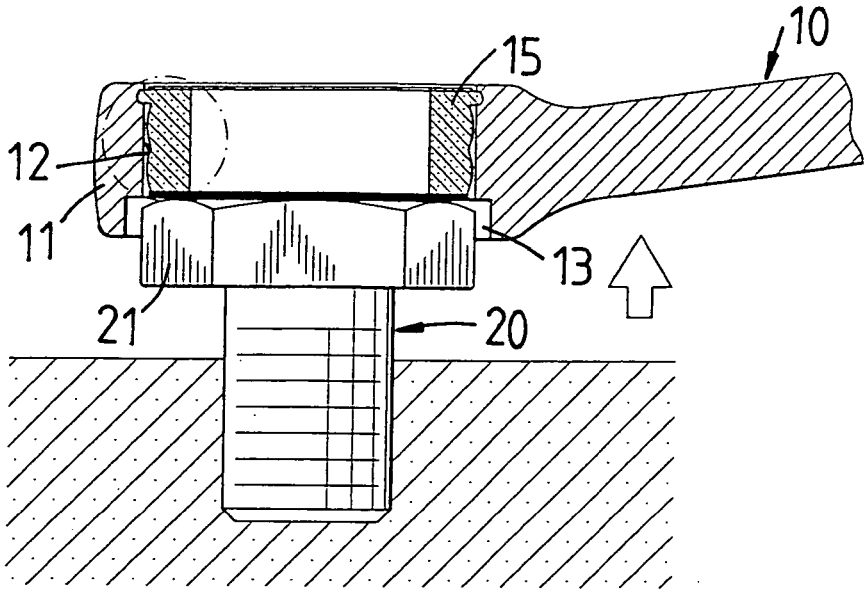
FIG. 6 shows the object is located in a space enclosed by the annular flange when slightly lifting the wrench.

Referring to FIGS. 1 to 3, the wrench of the present invention comprises a box end 11 connected to an end of a handle 10 and having a toothed inner periphery 12. An annular flange 13 extends from a first side of a periphery of the box end 11 and an inner diameter of the annular flange 13 is larger than a maximum inner diameter of the toothed inner periphery 12 of the box end 11. The annular flange 13 includes a smooth inner periphery such that the smooth inner periphery of the annular flange 13 does not clamp a bolt head 21 as shown in FIG. 6.

Figure 5:
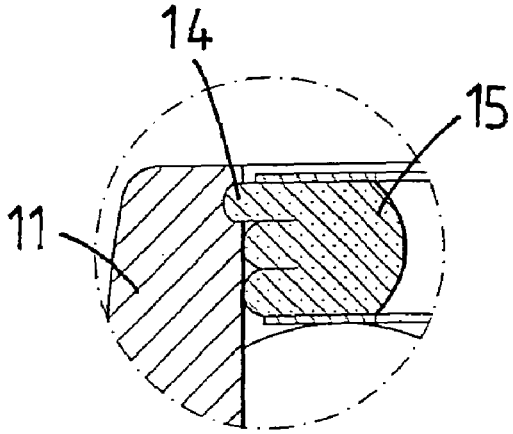
FIG. 5 is an enlarged view to show that the flexible member is compressed by the object during operating the wrench.
Figure 7:
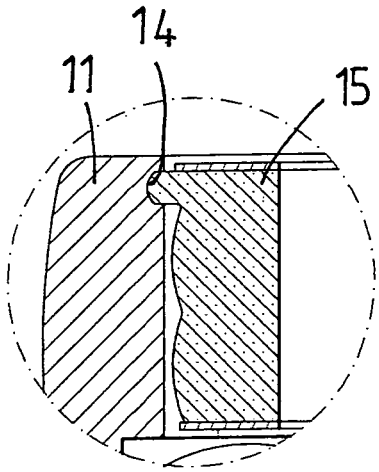
FIG. 7 is an enlarged view to show that the flexible member is not compressed by the object.
Figure 8:
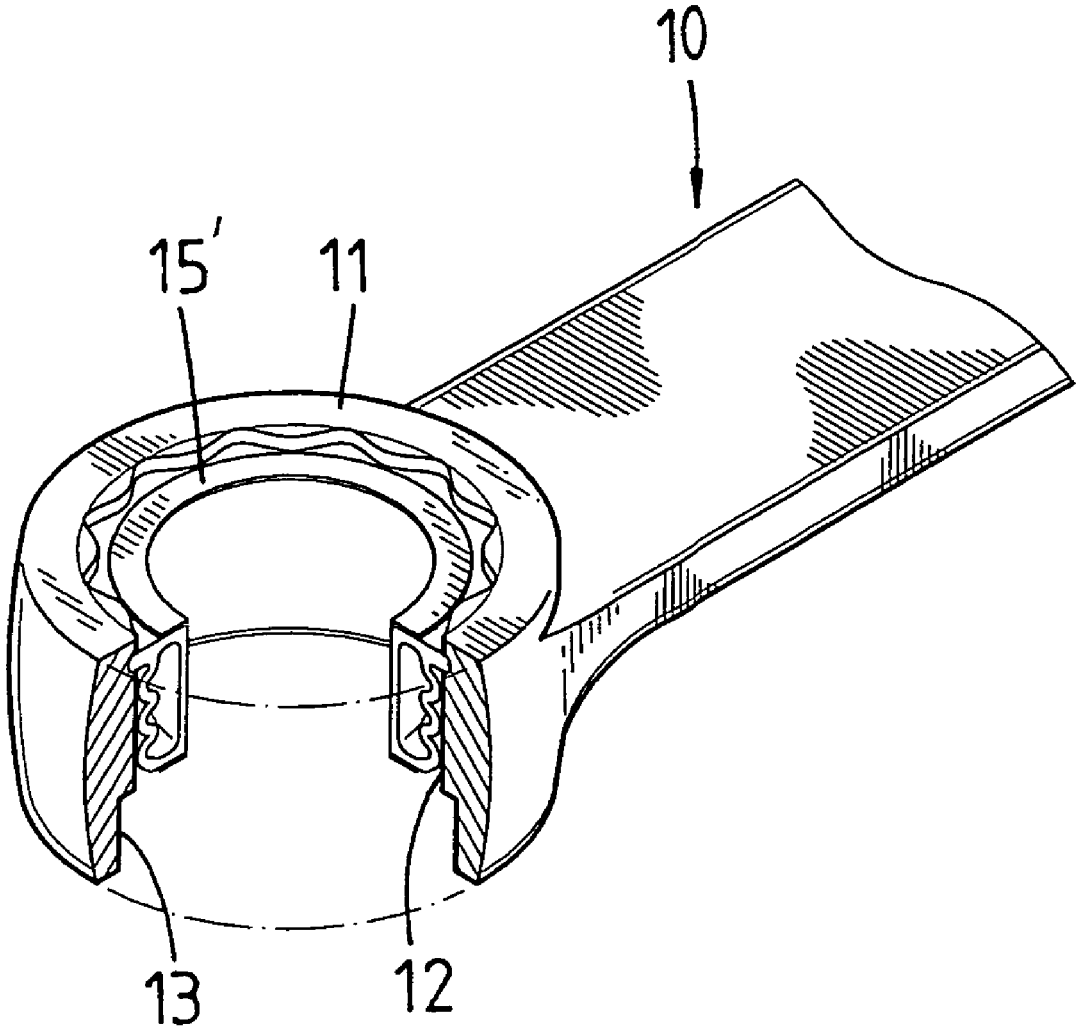
FIG. 8 is a cross sectional view to show another embodiment of the flexible member.
Figure 9:
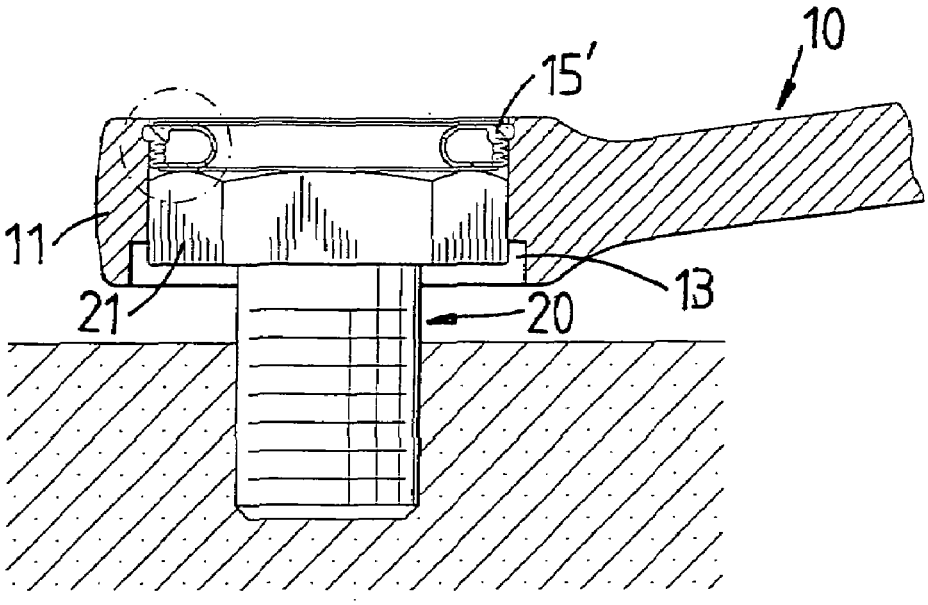
FIG. 9 shows the flexible member in FIG. 8 is compressed by the object during operating the wrench.
Figure 10:
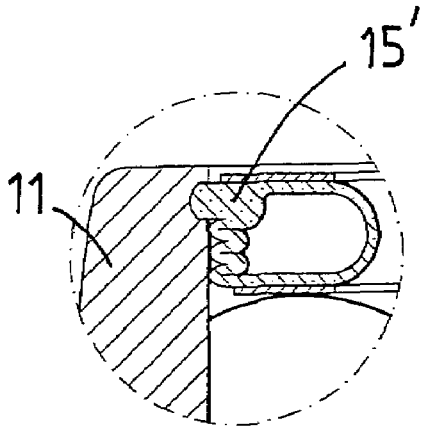
FIG. 10 is an enlarged view to show that the flexible member in FIG. 8 is compressed by the object during operating the wrench.
Figure 11:
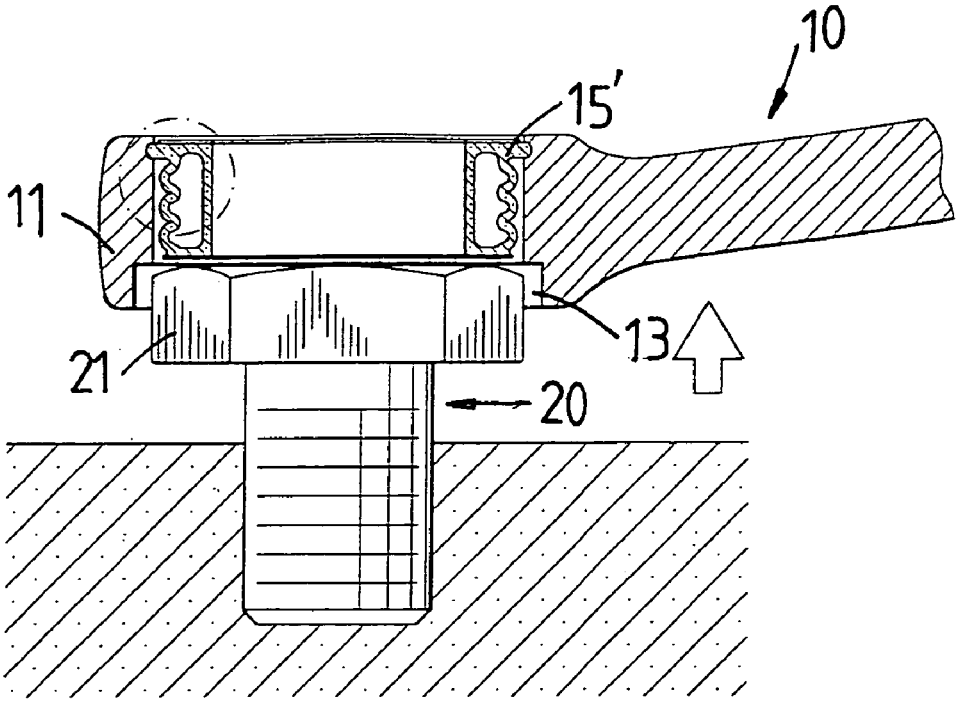
FIG. 11 shows the object is located in a space enclosed by the annular flange when slightly lifting the wrench.
Figure 12:
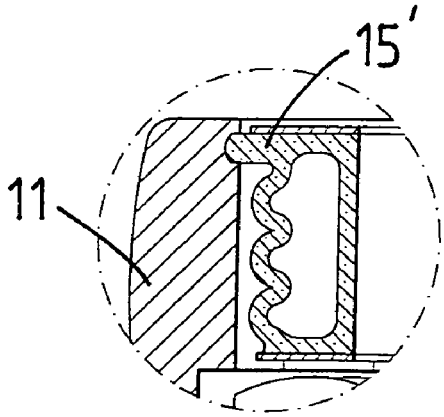
FIG. 12 is an enlarged view to show that the flexible member in FIG. 8 is not compressed by the object.

A compressible member 15 is engaged with a second side of the periphery of the box end 11 and a part of the compressible member 15 is located in a space enclosed by the toothed inner periphery 12. Further referring to FIGS. 5 and 7, the compressible member 15 has an outward flange which is engaged with an annular groove 14 defined in an inner periphery of the second side of the box end 11. The compressible member 15 includes a plurality of parallel ridges and grooves in an outer periphery thereof and the ridges and grooves are oriented perpendicularly to an axis of the box end 11. A gap is defined between an outer periphery of the compressible member 15 and the toothed inner periphery 12 of the box end 11 when the compressible member 15 is not compressed. The ridges and grooves allow the flexible member 15 to be compressed in an upright direction in the drawings at a regular way. Besides, the ridges make the contact area between the compressible member 15 and the toothed inner periphery 12 as small as possible so that the friction is minimized.

Referring again to FIGS. 4 to 7, when engaging a bolt head 21 of a bolt 20 by the toothed inner periphery 12 of the box end 11, the bolt head 21 applies an upright force to the compressible member 15 when the bolt 20 is gradually tightened. The upright force compresses the part of the compressible member 15 that is located in the space enclosed by the toothed inner periphery 12. When the handle 10 of the wrench cannot be rotated because of obstacles around the bolt 20, for example, the handle 10 is lifted a little bit, the bounce force of the compressible member 15 pushes the bolt head 21 to a space enclosed by the annular flange 13. Because the inner diameter of the annular flange 13 is larger than the bolt head 21, so that the box end 11 can be rotated freely independently such that the handle 10 can be rotated to a desired position while the box end 11 is not completely removed from the bolt head 21.

Referring to FIGS. 8 to 12, the flexible member 15' includes a hollow interior and performs as an air cushion. The hollow flexible member 15' is light in weight and the air in the closed interior is compressible so that it generates a bounce force when it is compressed.

While we have shown and described the embodiment in accordance with the present invention, it should be clear to those skilled in the art that further embodiments may be made without departing from the scope of the present invention.

What is claimed is:

1. A wrench comprising:

a box end connected to an end of a handle and having a toothed inner periphery, an annular flange extending from a first side of a periphery of the box end, an inner diameter of the annular flange being larger than a maximum inner diameter of the toothed inner periphery of the box end, and a compressible member engaged with a second side of the periphery of the box end and a part of the compressible member located in a space enclosed by the toothed inner periphery, the compressible member including a hollow and closed interior and air in the closed interior generating a bounce force when the compressible member is compressed.

2. The wrench as claimed in claim 1, wherein the compressible member has an outward flange which is engaged with an annular groove defined in an inner periphery of the second side of the box end.

3. The wrench as claimed in claim 1, wherein a gap is defined between an outer periphery of the compressible member and the toothed inner periphery of the box end when the compressible member is not compressed.

4. The wrench as claimed in claim 1, wherein the compressible member includes a plurality of parallel ridges and grooves in an outer periphery thereof and the ridges and grooves are oriented perpendicularly to an axis of the box end.

5. The wrench as claimed in claim 1, wherein the annular flange includes a smooth inner periphery.

* * * * *